US006402553B1

(12) United States Patent
Schwarz et al.

(10) Patent No.: US 6,402,553 B1
(45) Date of Patent: Jun. 11, 2002

(54) ELECTRIC PLUG CONNECTION ARRANGEMENT

(75) Inventors: Dieter Schwarz, Neubulach; Edwin Muz, Reutlingen, both of (DE)

(73) Assignee: Nicolay Verwaltungs-GmbH, Nagold (DE)

( * ) Notice: Subject to any disclaimer, the term of this patent is extended or adjusted under 35 U.S.C. 154(b) by 0 days.

(21) Appl. No.: 09/544,630

(22) Filed: Apr. 6, 2000

(30) Foreign Application Priority Data

Apr. 7, 1999 (DE) ..... 199 15 562

(51) Int. Cl.[7] ..... H01R 13/648
(52) U.S. Cl. ..... 439/607; 439/944
(58) Field of Search ..... 439/188, 607, 439/944

(56) References Cited

U.S. PATENT DOCUMENTS 4,552,423 A * 11/1985 Swengel, Jr.
5,904,579 A * 5/1999 McLean et al. ..... 439/63

FOREIGN PATENT DOCUMENTS

DE 8517334 U1 9/1985
DE 3909912 A1 9/1990
DE 4404260 A1 8/1995

* cited by examiner

*Primary Examiner*—Khiem Nguyen
(74) *Attorney, Agent, or Firm*—Roylance, Abrams, Berdo & Goodman, L.L.P.

(57) ABSTRACT

A plug connection arrangement or electrical connector includes at least one plug element with an electrical contact member to produce an electrical connection of a cable with a complementary contact member and a connection housing with at least one plug-holding fixture with the complementary contact member. An electrical shielding of the connection housing has a flexible shield contact spring extending into the plug-holding fixture and pre-biased for contacting the complementing contact member of the plug-holding fixture. A coaxial insulating body surrounds the contact member of the plug element in a contact-proof and shock-proof manner. A groove extends in the plug element exterior surface in a longitudinal direction, and holds the contact spring end part upon the insertion of the plug element into the plug-holding fixture.

11 Claims, 2 Drawing Sheets

ELECTRIC PLUG CONNECTION ARRANGEMENT

FIELD OF THE INVENTION

The present invention relates to an electric plug connection arrangement, especially to an arrangement where a plug connection is to be used for medical/electrical purposes according to DIN 42802. The plug connector provides contact-protected or shock-proof connection of cables, for example for conductors extending from a patient to medical/electrical apparatus.

BACKGROUND OF THE INVENTION

Connection arrangements of this type are already known. One drawback of the known arrangements resides in that occasionally plug elements and plug-holding fixtures of different configurations must be brought into use, depending on whether the connection is to be made with shielded or unshielded cables. With arrangements having shielded leads or conductors, special plug connections are provided in turn for the formation of the contact of signal conductor and shielding.

SUMMARY OF THE INVENTION

Objects of the present invention are to provide a simply constructed plug connection arrangement which is characterized by limited space requirements and is suitable for the connection of plug elements with either shielded or unshielded cables.

The foregoing objects are basically obtained by an electrical connector, comprising at least one plug element that is connectable to a cable and has a plug electrical contact member and a tubular insulating body surrounding and extending coaxially relative to the plug contact member. The insulating body is open at one end thereof to provide access to the plug contact member. A connection housing includes at least one plug-holding fixture for receiving the plug element. The plug-holding fixture has a housing contact member matable with the plug contact member and extendable through the open end of the insulating body. Electrical shielding is coupled to the connection housing. The electrical shielding has a flexible shield contact spring extending into the plug-holding fixture. The shield contact spring has an end part pre-biased to contact the housing contact member. A groove extends in an exterior surface of the insulating body parallel to a longitudinal axis thereof. The groove has a width adapted to a breath of the shield contact spring to receive the end part as the end part is disconnected from the housing contact member upon insertion of the plug element into the plug-holding fixture.

A coaxial connection arrangement is thus provided by which the same plug-holding fixture can be used regardless of whether the plug element to be inserted is coupled to a shielded or an unshielded cable. The shield-contact spring is pre-biased against the contact member in the plug-holding fixture, is raised upon insertion of the plug element, and is received and held in the longitudinal groove of the insulating body of the plug element. An additional advantage of the arrangement according to the present invention resides in that, before the insertion of the plug element, in other words when the plug-holding fixture is not in use, the housing contact member is short-circuited by means of the contact spring.

When plug elements with shielded cables are involved, since the groove extends longitudinally in the insulating body of the plug element, a shield contact of the shielding of the cable is accessible. Plug element insertion in the plug-holding fixture causes formation of the contact with the shield-contact spring of the plug-holding fixture. Thus, when the connection is produced for the signal conduction, the electrical connection of the shielding occurs simultaneously.

The arrangement according to the present invention is in full compliance with the standard regulations in effect for such arrangements. In the case of the plug element, a contact member can be provided according to DIN 42802, which cooperates in the plug-holding fixture with a complementary contact member in the form of a metal pin. The short-circuiting shield-contact spring is raised upon insertion of the plug element.

The tubular insulating body of the plug element can have a metal tube, on an interior insulating tube, which metal tube is coupled to the shield of the cable. The metal tube can be surrounded by an exterior insulating tube, which covers the metal tube and includes the shield contact in a contact-proof and shock-proof manner. The access of the shield-contact spring of the plug-holding fixture to the shield contact of the plug element occurs through a longitudinal groove or slot in the exterior insulating tube. With insertion of the plug element in the plug-holding fixture, the shield-contact spring is guided into this slot, and thus, produces the electrical connection of the shielding. The width of the longitudinal slot, and correspondingly the breadth of the contact spring, are selected to be sufficiently narrow that a testing tool corresponding to DIN IEC 601 cannot contact the metal tube. Thus the metal tube forming the shield contact is construed as non-contactable.

A catch projection can be provided in the slot of the exterior insulating tube of the plug element. In corporation with the contact spring of the plug-holding fixture, the catch projection forms a releasable catching device for the inserted plug element. Thus, a special advantage is obtained that the force for detaching the plug connection can be adjusted independent of the contact force by selection of the holding effect of the catch device in any desired, suitable manner.

Other objects, advantages and salient features of the present invention will become apparent from the following detailed description, which, taken in conjunction with the annexed drawings, disclose a preferred embodiment of the present invention.

BRIEF DESCRIPTION OF THE DRAWINGS

Referring to the drawings which form a part of this disclosure.

DETAILED DESCRIPTION OF THE INVENTION

Figure 2:
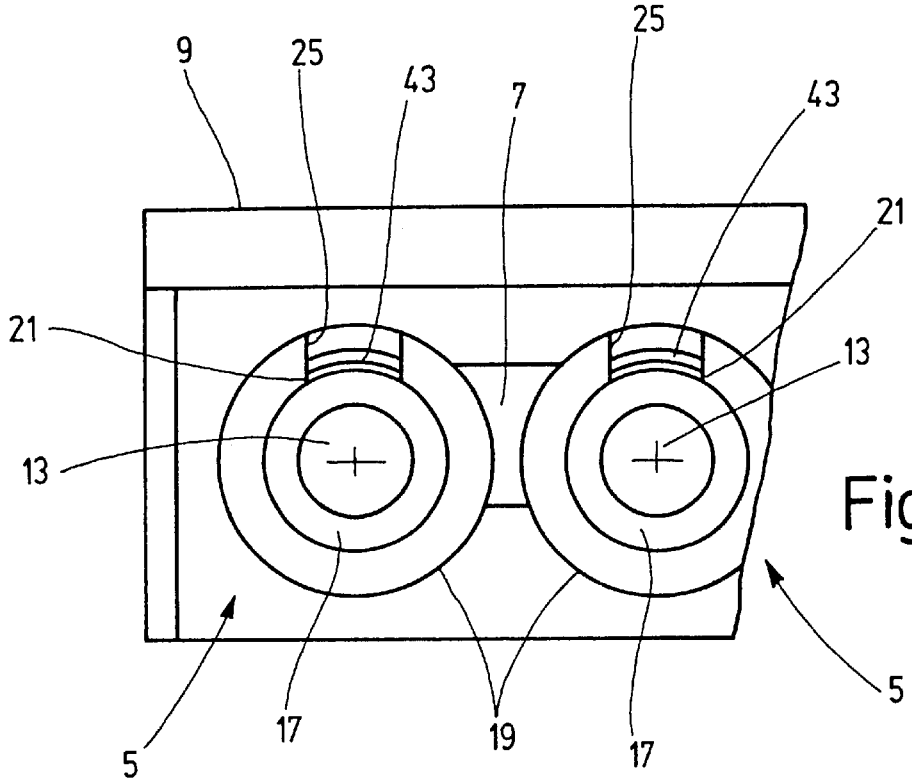
FIG. 2 is an enlarged, partial, front elevational view of a plug housing with one set of plug elements according to an embodiment of the present invention.
Figure 1:
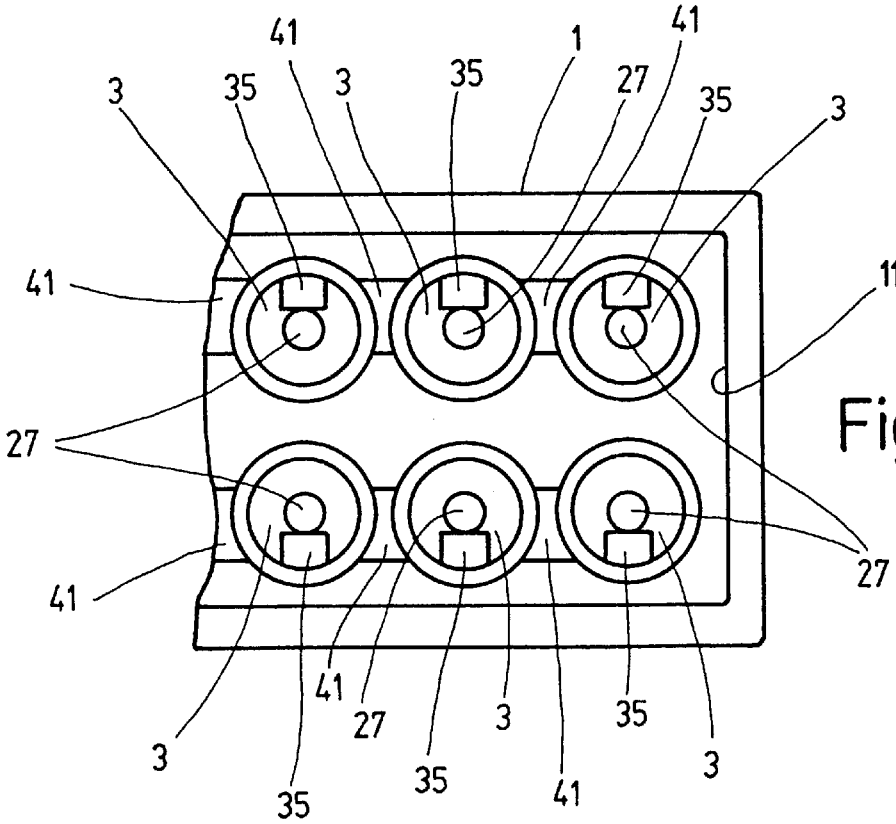
FIG. 1 is a partial, front elevational view of a connection housing with two sets of plug-holding fixtures according to an embodiment of the present invention.
Figure 3:
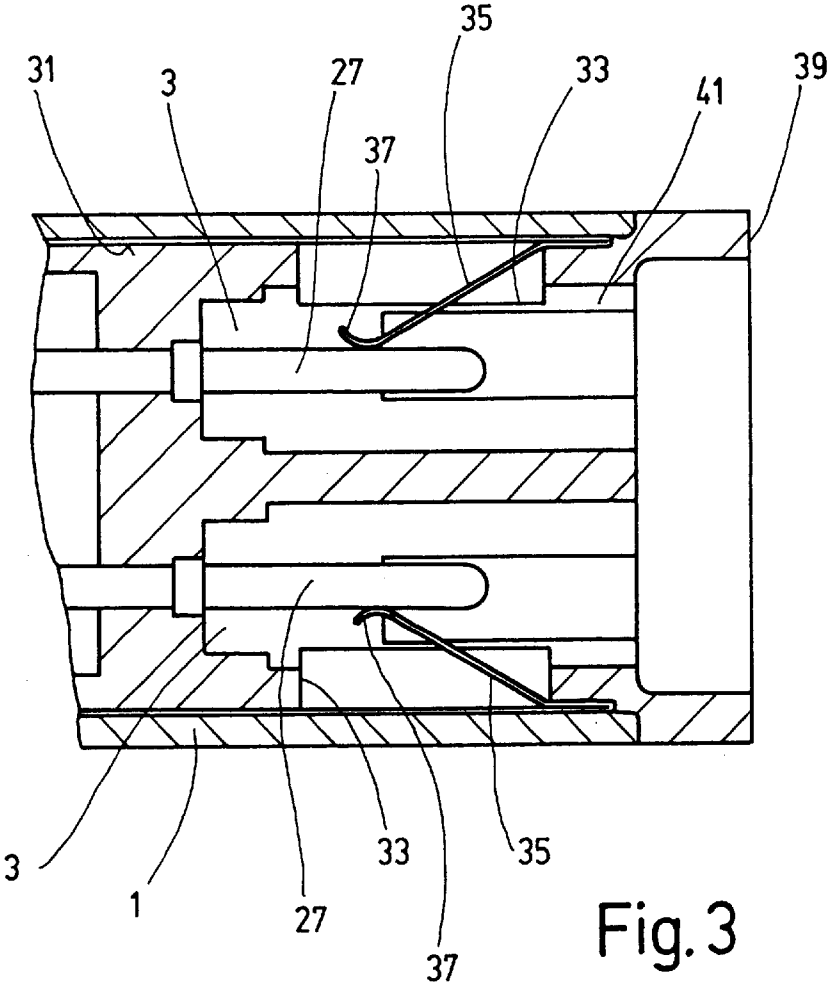
FIG. 3 is a side elevational view in section of the connection housing of FIG. 1.

A connection housing 1, as shown in FIGS. 1 and 3, involves a main cable distributing box. In the present example, a plurality of patient leads can be connected through the distributing box with a mechanical/electrical analysis and/or evaluation apparatus. Connection housing 1 incorporates two sets of identically configured plug-holding fixtures or sockets 3. The plug-holding fixtures of the top set are in mirror-image alignment with those of the bottom group. Each plug-holding fixture 3 is intended to receive a plug element 5 which can be inserted therein. FIG. 2 shows plug elements 5 brought together to form a plug group. These plug elements are connected with one another by a crosspiece 7 positioned at the side, and are arranged in a common plug housing 9. The peripheral outlines of the plug housing is fitted to that of the frontal access opening 11 of the connection housing 1.

Figure 4:
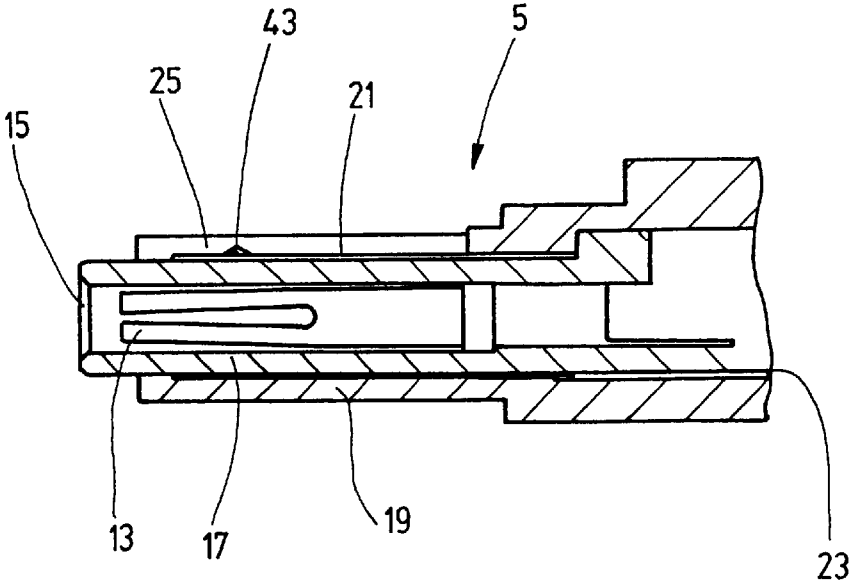
FIG. 4 is a side elevational view in section of one individual plug element of FIG. 2, before insertion into a plug holding fixture of the connection housing of FIG. 3.

As shown in FIG. 4, plug element 5 is constructed in accordance with DIN 42802, having an interior contact-proof and shock-proof covered electrical contact member 13 in the form of a spring contact. This spring contact is covered by an insulating body open at its forward end 15. The insulating body extends coaxially to the main or longitudinal axis of plug element 5. This insulating body is formed of an interior insulating tube 17 and an exterior insulating tube 19, between which is located a metal tube 21. Metal tube 21 is connected electrically with the shield 23 of the cable (not shown) connected to the plug element 5. The cable interior signal conductor is connected with the electrical contact member 13.

Metal tube 21 is accessible by means of a longitudinal slot or groove 25 in exterior insulating tube 19, for formation of an electrical contact. In other words, a part of metal tube 21 lies exposed in the area of slot 25, and forms a shield contact of plug element 5.

Plug-holding fixture or socket 3 for receiving a plug element 5 in connection housing 1 has a metal pin 27 forming a complementary electrical contact member for connection with the contact member 13 of the relevant plug element 5. On the interior of the exterior wall of connection housing 1, the housing incorporates a metallic shielding 31. The side of each plug-holding fixture 3 facing the adjacent housing wall has a passage 33 extending as far as shielding 31. A leaf spring-like contact spring 35 extends through passage 33. One end of contact spring 35 is connected with shielding 31. The other bend end 37 of contact spring 35 engages flexibly or resiliently and contacts pin 27 of the plug-holding fixture 3, when no plug element 5 is inserted. As seen in FIG. 3, contact spring 35 is inclined in such a manner that, with insertion of plug element 5, contact spring end part 37 extends to the outside of the plug element insulating body formed of insulating tubes 17 and 19 and is raised from pin 27.

With insertion of plug element 5 into plug-holding fixture 3, the bent end 37 of contact spring 35 is raised from pin 27, and is guided into longitudinal slot 25 of exterior insulating tube 19, where it comes into a flexible contact-forming arrangement with metal tube 21 and forms the shield contact by lying exposed in slot 21. Simultaneously, the plug connection of the relevant signal conductor occurs through pin 27 and the spring contact member 13 of plug element 5. Before the insertion of plug element 5, the plug-holding fixture 3 not being used is short-circuited over contact spring 35. The insertion of plug element 5 then causes neutralization of the short-circuited state by raising contact spring 35 and the resulting connection of shielding 31 with the cable shield 23 adjacent to the plug, while the signal connection is produced.

When a patient lead cable without shielding is being used, the identical plug element 5 can be used, as is shown in FIG. 4. Alternatively, the metal tube 21 forming the shield contact can be deleted. In any case the breadth of slot 25, into which contact spring 35 is guided with insertion of plug element 5 into plug-holding fixture 3, is selected to be sufficiently narrow in adaptation to the breadth of contact spring 35 that metal tube 21 being exposed at the base of slot 25 cannot be contacted by a standard testing digit, in accordance with DIN 42802.

To guarantee the correct orientation of plug element 5 during insertion into connection housing 1, housing 1 has recesses 41 located at the connection housing introduction or forward end 39. The recesses are offset in relation to the axis of plug-holding fixtures 3 and receive the axially offset cross pieces or connecting pins 7 on plug elements 5 upon their insertion in connection housing 1.

To increase the detachment force required for removal of plug element 5 from plug-holding fixture 3, contact spring 35 is held in slot 25 of plug element 5 to form a releasable catching device for resisting withdrawal. A shown in FIGS. 2 and 4, a transverse crosspiece 43 is provided in slot 25 as a projecting catch. End part 37 of contact spring 35 drops behind crosspiece 43 when plug element 5 is inserted in plug-holding fixture 3. Instead of a crosspiece 43, a projecting catch could be configured as a concavity or convexity pressed out of metal tube 21. In an advantageous manner, such catch device can be used to adjust the detachment force required for removal of plug element 5 independent of the contact force.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

at least one plug element, connectable to a cable, having a plug electrical contact member and a tubular insulating body surrounding and extending coaxially relative to said plug contact member, said insulating body being open at one end thereof to provide access to said plug contact member;

a connection housing including at least one plug-holding fixture for receiving said plug element, said plug-holding fixture having a contact member mateable with said plug contact member and extendable through said open end of said insulating body;

electrical shielding coupled to said connection housing, said electrical shielding having a flexible shield contact spring extending into said plug-holding fixture, said shield contact spring having an end part pre-biased to contact said housing contact member; and a groove extending in an exterior surface of said insulating body parallel to a longitudinal axis thereof, said groove having a width adapted to a breadth of said shield contact spring to receive said end part as said end part is disconnected from said housing contact member upon insertion of said plug element into said plug-holding fixture.

2. An electrical connector according to claim 1 wherein said electrical shielding is located on a wall of said connection housing; and said shield contact spring extends through a passage in said connection housing from said electrical shielding into said plug-holding fixture.

3. An electrical connector according to claim 2 wherein said shield contact spring is unitarily formed as one piece with said electrical shielding.

4. An electrical connector according to claim 1 wherein said shield contact spring is unitarily formed as one piece with said electrical shielding.

5. An electrical connector according to claim 1 wherein said electrical shielding and said contact spring are made of spring plate.

6. An electrical connector according to claim 2 wherein said electrical shielding and said contact spring are made of spring plate.

7. An electrical connector according to claim 1 wherein said plug element comprises a shield contact connectable to shielding of a cable, said shield contact lying exposed at a base of said groove and being electrically connectable with said shield contact spring.

8. An electrical connector according to claim 7 wherein said shield contact comprise a metal tube which can surround an exterior of the cable; and said tubular insulating body comprises an interior insulating tube and an exterior insulating tube having on opposite sides of said metal tube, said exterior insulating tube having said groove in which said metal tube lies exposed for engaging said contact spring.

9. An electrical connector according to claim 8 wherein said metal tube comprises a catch projection located in said groove of said exterior insulating tube and cooperating with said contact spring to form a releasable catch between said plug element and said plug-holding fixture.

10. An electrical connector according to claim 1 wherein said plug element comprises a cross piece projecting laterally outwardly;

said connection housing comprises a mating formation in which said cross piece can be received in an access area of said plug-holding fixture to set and hold said plug element in a proper orientation upon insertion of said plug element in said plug-holding fixture.

11. An electrical connector according to claim 10 wherein said plug element is joined in a plug set to other plug elements by cross pieces extending laterally therebetween.

* * * * *